US005377633A

United States Patent [19]

Wakeman

[11] Patent Number: 5,377,633

[45] Date of Patent: Jan. 3, 1995

[54] RAILPLUG DIRECT INJECTOR/IGNITOR ASSEMBLY

[75] Inventor: Russell J. Wakeman, Newport News, Va.

[73] Assignee: Siemens Automotive L.P., Auburn Hills, Mich.

[21] Appl. No.: 90,418

[22] Filed: Jul. 12, 1993

[51] Int. Cl.[6] ..... F02M 57/06

[52] U.S. Cl. ..... 123/297; 123/143 B

[58] Field of Search ..... 123/297, 143 B, 538

[56] References Cited

U.S. PATENT DOCUMENTS

| | | | |
|---|---|---|---|
| 3,502,055 | 3/1970 | Beesch | 123/297 |
| 3,926,169 | 12/1975 | Leshner et al. | 123/297 |
| 4,203,393 | 5/1980 | Giardini | 123/143 B |
| 4,319,552 | 3/1982 | Sauer et al. | 123/297 |
| 4,448,160 | 5/1984 | Vosper | 123/297 |
| 4,546,740 | 10/1985 | Clements et al. | 123/143 B |
| 4,620,516 | 11/1986 | Reum et al. | 123/297 |
| 4,967,708 | 11/1990 | Linder et al. | 123/297 |
| 4,969,432 | 11/1990 | Scharnweber et al. | 123/143 B |
| 5,211,142 | 5/1993 | Matthews et al. | 123/143 B |
| 5,211,147 | 5/1993 | Ward | 123/418 |

*Primary Examiner*—David A. Okonsky

*Attorney, Agent, or Firm*—George L. Boller; Russel C. Wells

[57] ABSTRACT

A high pressure fuel injector has a railplug ignitor assembly disposed on its nozzle. The injected fuel travels down the bore of the railplug. The railplug delivers a plasma that travels down the bore of the railplug in timed relation to the injected fuel to ignite the fuel.

5 Claims, 2 Drawing Sheets

RAILPLUG DIRECT INJECTOR/IGNITOR ASSEMBLY

FIELD OF THE INVENTION

This invention relates generally to direct injection of fuel into a combustion chamber of an engine and ignition of the injected fuel by an ignitor.

BACKGROUND AND SUMMARY OF THE INVENTION

Direct injection in Otto cycle engines offers significant performance benefits for both two-stroke and four-stroke engines, including improved fuel economy, reduced exhaust emissions, improved transient response, and increased power. However, adaption of direct injection to a given engine may be confronted by one or more problems.

For example, mounting space in a cylinder head may be limited, and so the injector location may have to be compromised, possibly to the detriment of combustion performance.

Another example involves ignition of the fuel cloud created by a direct injector. Particularly when the injector is used to create a stratified charge in the center of the cylinder, ignition by spark plug may require either extending fragile electrodes into the cylinder space, or else compromising the ignition point by using a more conventional spark plug to the side.

Leaner air-fuel mixtures do not reliably ignite with conventional electric spark mechanisms. Moreover, effective combustion of the fuel-air mixture is often problematic. If the ignitor is located adjacent a relatively cool combustion chamber wall, as with a conventional spark plug, the rate of heat loss to the wall may lead to flame quench, incomplete combustion, increased fuel consumption, and increased hydrocarbon emissions.

In order to better ignite leaner mixtures, a much hotter electrical energy source is required. Furthermore, in certain engines, such as two-stroke engines, the fuel charge needs to be ignited very quickly.

One means of providing hotter ignition is a new type of ignitor, called a miniaturized railgun or railplug. Such an ignitor can produce a high velocity jet that is driven by both electromagnetic and thermal forces. U.S. Pat. No. 5,076,223, describes a plasma jet ignitor, or railplug, which utilizes a plasma injector. The railplug of the '223 patent operates on the principle of electromagnetics, wherein the electromagnetic accelerating force causes plasma to propagate down the railplug bore to achieve supersonic speeds at the muzzle exit. However, even if a conventional spark plug were replaced by a railplug, a separate fuel injector would still be needed, and packaging and ignition issues would remain.

The present invention relates to a novel association of a railplug ignitor with a fuel injector. The railplug produces a high velocity jet of plasma between two long slender electrodes which is accelerated into the combustion chamber by a combination of thermal and electromagnetic forces along the same path as the fuel being ignited since the ignited fuel passes through the bore of the railplug. The ignition is timed in relation to the injection.

In accordance with one embodiment of the present invention, a railplug is adapted for fitting over the nozzle of a fuel injector. A connection to ground for one railplug electrode is achieved through the railplug shell to the engine cylinder head, and a connection of the other railplug electrode to the ignition electronics is achieved through an insulated source terminal.

For a full understanding of the nature and objects of the present invention, reference may be had to the following detailed description taken in conjunction with the accompanying drawings and the appended claims.

DESCRIPTION OF THE PREFERRED EMBODIMENT

Figure 1:
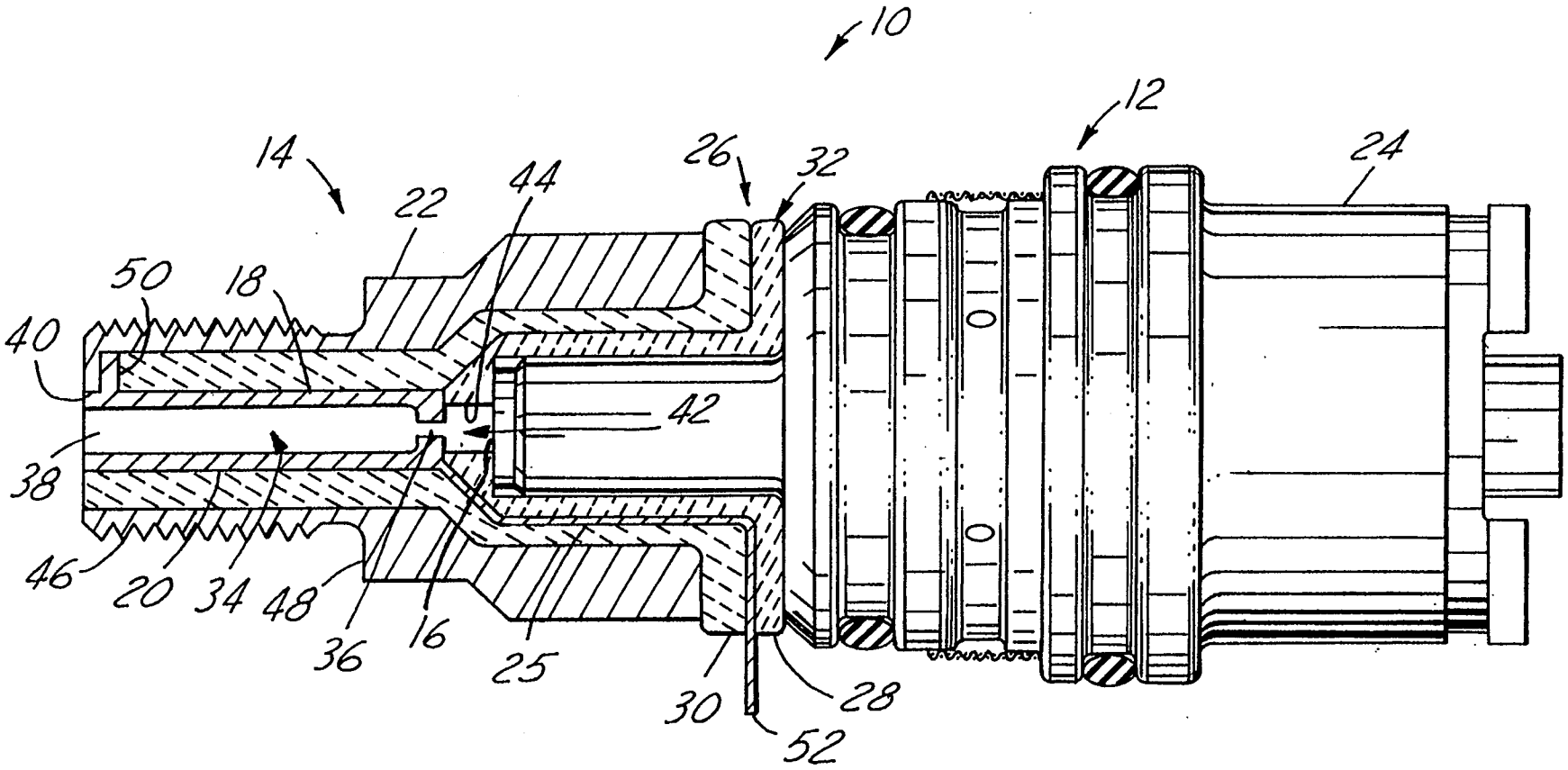
FIG. 1 illustrates a high pressure fuel injector and railplug assembly in accordance with one embodiment of the present invention, the railplug being shown in cross-section.
Figure 2:
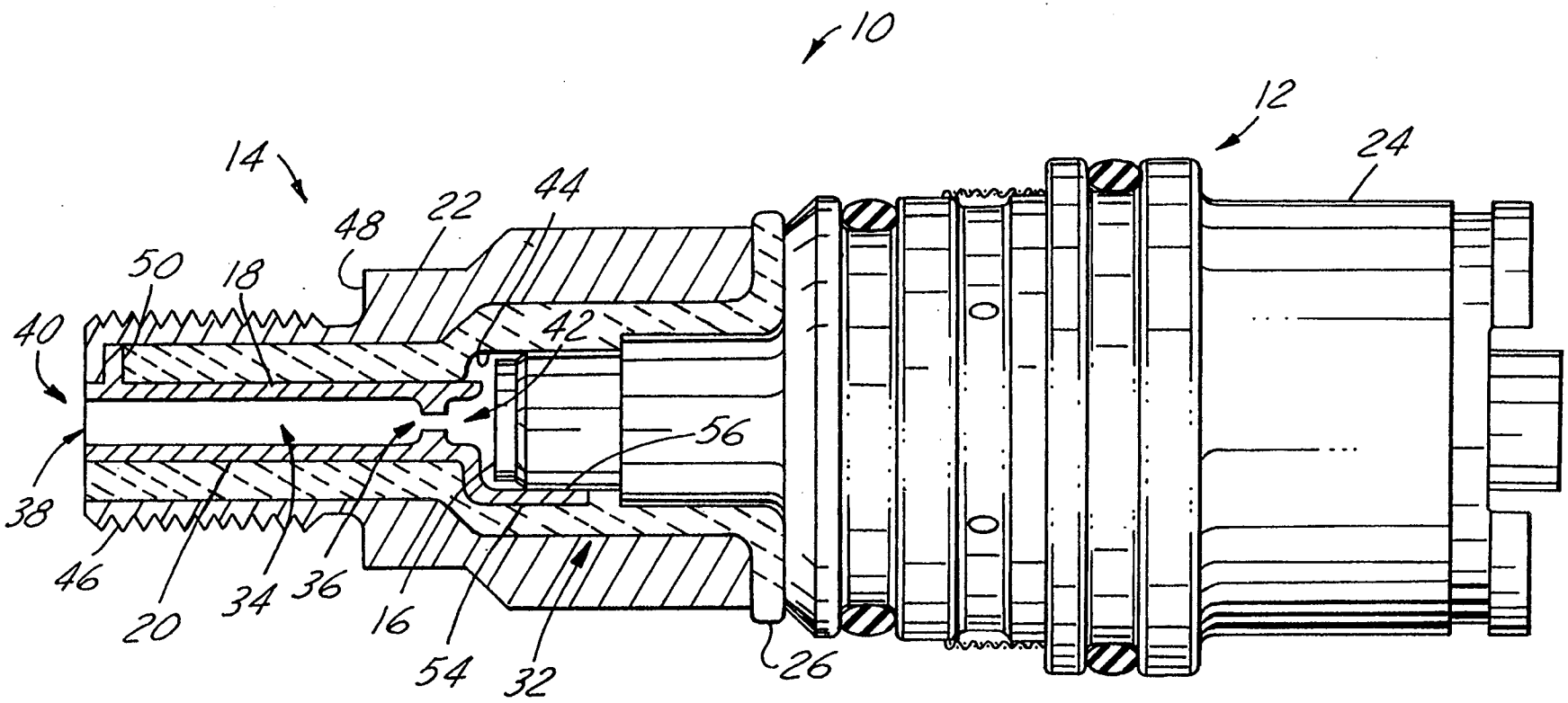
FIG. 2 is view similar to FIG. 1 in accordance with another embodiment.

Referring to the drawings, FIGS. 1 and 2 illustrate a high pressure fuel injector and railplug assembly 10 in accordance with the present invention and comprising a high pressure fuel injector 12 and a railplug 14. Railplug 14 is disposed over a nozzle 16 at one end of injector 12 for acting on fuel injected from nozzle 16. Railplug 14 is basically a tube that comprises first and second spaced apart electrodes, namely a ground electrode 18 and a source electrode 20 diametrically opposite each other on the I.D. of the tube bore. The fuel discharge from injector 12 is directed through the tube between the long slender electrodes 18 and 20.

A connection to ground for electrode 18 is provided through a steel housing 22 of the railplug that threads into a tapped hole in an engine cylinder head (not shown). A connection of electrode 20 to an ignition circuit (not shown) is provided in FIG. 1 by a terminal 25 most of which is embedded in an insulation means 26 of the railplug comprising an inner insulator 28 and an outer insulator 30.

The electrodes 18, 20 and insulation means 26 create an insulator and electrode assembly 32 having an air gap 34 arranged between the electrodes. The gap is narrower at location 36 where the arc will first be struck when the ignition circuit delivers a suitable voltage, and a wider air gap at location 38 leading to>the discharge into the cylinder at an end 40 of assembly 32.

The injector 12 is arranged such that the injected fuel is directed between electrodes 18 and 20. It passes first through an enlarged cylindrical space 42 formed by an inside diameter 44 of insulation means 26 and continues the length of electrodes 18 and 20 to exit at end 40. Consequently, the railplug acts on the fuel as the fuel is injected from nozzle 16.

Housing 22 is provided at the end with standard spark plug threads 46, sealing, and a hex 48 for mounting purposes. The housing is connected electrically to ground by threading it into the cylinder head, as in a conventional spark plug.

The ground electrode 18 is electrically connected to the railplug housing 22 by a tab 50 that extends past the insulation means 26 to make contact with the railplug housing 22.

In FIG. 2, contact of electrode 20 with the source is made through an insulated terminal exceeding through the body 24 of injector 12. The source electrode; 20 in FIG. 2 includes an extending portion 54 which contacts one end of a terminal at location 56. The connection through an insulated terminal extending through the fuel injector allows for an electrical connection to the ignition circuit source be made at the end of injector 12 opposite nozzle 16. In FIG. 1, terminal 25 has an external blade 52 that can be connected to the ignition circuit source.

In practice, assembly 10 is controlled to insure close proximity of the plasma jet and the cloud of fuel created by the high pressure injector. Timing is determined by the relative rates of travel of the plasma jet and the fuel cloud so that the plasma jet exposes the maximum volume of fuel in the cloud to the surface of the jet. This would insure the maximum area in a flame front which would expand from the center of the fuel cloud in all directions to the outer surface of the stratified charge. Burn rate and combustion stability would be maximized, making optimum use of the fuel in the chamber.

The present invention is particularly applicable for use with two-stroke engines, where it is desired to create a fuel charge very quickly. In the present invention, the railplug is disposed around the nozzle so that ignition can begin as soon as fuel is injected from the nozzle.

Although prior art railplugs propagate plasma, there is no fuel mixed initially mixed with the plasma, as there is in the present invention. In the prior art, the fuel charge is created elsewhere, whereas with the present invention the fuel is introduced at the cylindrical air space 42 formed by the inside diameter 44 of the ceramic insulating means 30, when the fuel is injected from the nozzle.

What is claimed is:

1. A high pressure fuel injector assembly for injecting a high energy plasma jet into a combustion chamber, comprising:

a high pressure fuel injector having a nozzle from which fuel is injected;

a railplug assembly disposed on said nozzle for acting on the fuel as the fuel is injected from said nozzle, said railplug assembly comprising means defining a bore through which fuel injected from said nozzle is constrained to pass upon leaving said nozzle, said means defining a bore including insulative means supporting respective elongate electrodes on opposite diametrical portions of said bore in mutually electrically insulated relationship, each of said electrodes extending lengthwise of said bore and being constructed and arranged to be in closer proximity to each other at a lengthwise location that is proximate, but spaced from, said nozzle such that said electrodes have longer lengths and are farther apart from each other beyond said location in a direction toward an exit of said bore such that when suitable electrical potential is applied across said electrodes, initial arcing occurs between said electrodes at said location to intersect the fuel being injected from said nozzle at said location.

2. A high pressure fuel injector assembly as claimed in claim 1 wherein said electrodes comprise two electrodes that are directly diametrically opposite each other.

3. A high pressure fuel injector assembly as claimed in claim 2 wherein said nozzle has an outlet lying on a main longitudinal axis for injecting fuel along that axis, said bore has an axis coincident with said main longitudinal axis, and said electrodes are disposed transversely equidistant from said bore axis.

4. A high pressure fuel injector assembly as claimed in claim 1 wherein the injected fuel enters a cylindrical space of said bore formed by an inside diameter of said insulative means immediately upon being injected from the fuel injector and before reaching said location.

5. A high pressure fuel injector assembly as claimed in claim 2 in which each of said electrodes has a radially inward projection at said location to make said closer proximity at said location.

* * * * *